US006564847B1

(12) United States Patent
Herrmannsen et al.

(10) Patent No.: US 6,564,847 B1
(45) Date of Patent: May 20, 2003

(54) DEVICE FOR TRANSFERRING A MATERIAL IN THE FORM OF A FILM APPLIED ON A CARRIER STRIP

(75) Inventors: Wulf Herrmannsen, Ronnenberg (DE); Christoph Manusch, Hemmingen (DE); Wolfgang Bauersachs, Wedemark (DE)

(73) Assignee: Pritt Produktionsgesellschaft mbH (DE)

( * ) Notice: Subject to any disclaimer, the term of this patent is extended or adjusted under 35 U.S.C. 154(b) by 0 days.

(21) Appl. No.: 09/743,134

(22) PCT Filed: Jun. 29, 1999

(86) PCT No.: PCT/EP99/04476

§ 371 (c)(1),
(2), (4) Date: Apr. 2, 2001

(87) PCT Pub. No.: WO00/02806

PCT Pub. Date: Jan. 20, 2000

(30) Foreign Application Priority Data

Jul. 8, 1998 (DE) ..... 198 30 522

(51) Int. Cl.[7] ..... B32B 31/00

(52) U.S. Cl. ..... 156/577; 156/579; 118/76; 118/257; 242/160.4; 242/171; 242/588.6

(58) Field of Search ..... 156/238, 523, 156/527, 540, 574, 577, 579; 225/46; 118/76, 200, 257; 242/160.2, 160.4, 170, 171, 588, 588.2, 588.3, 588.6

(56) References Cited

U.S. PATENT DOCUMENTS 5,759,270 A * 6/1998 Lee ..... 118/200
D410,494 S * 6/1999 Hoffmann ..... D19/67

* cited by examiner

*Primary Examiner*—Mark A. Osele
(74) *Attorney, Agent, or Firm*—Connolly Bove Lodge & Hutz LLP

(57) ABSTRACT

A device for transferring a film from a carrier strip a substrate comprises a supply reel for the film coated carrier strip and an empty reel for receiving the de-coated carrier strip. The carrier strip is guided over an applicator base and over deflector rollers. The effective working edge of applicator base is arranged to be inclined at a fixed angle between 40° and 50° relative to the reel axes.

8 Claims, 3 Drawing Sheets

Figure 1:
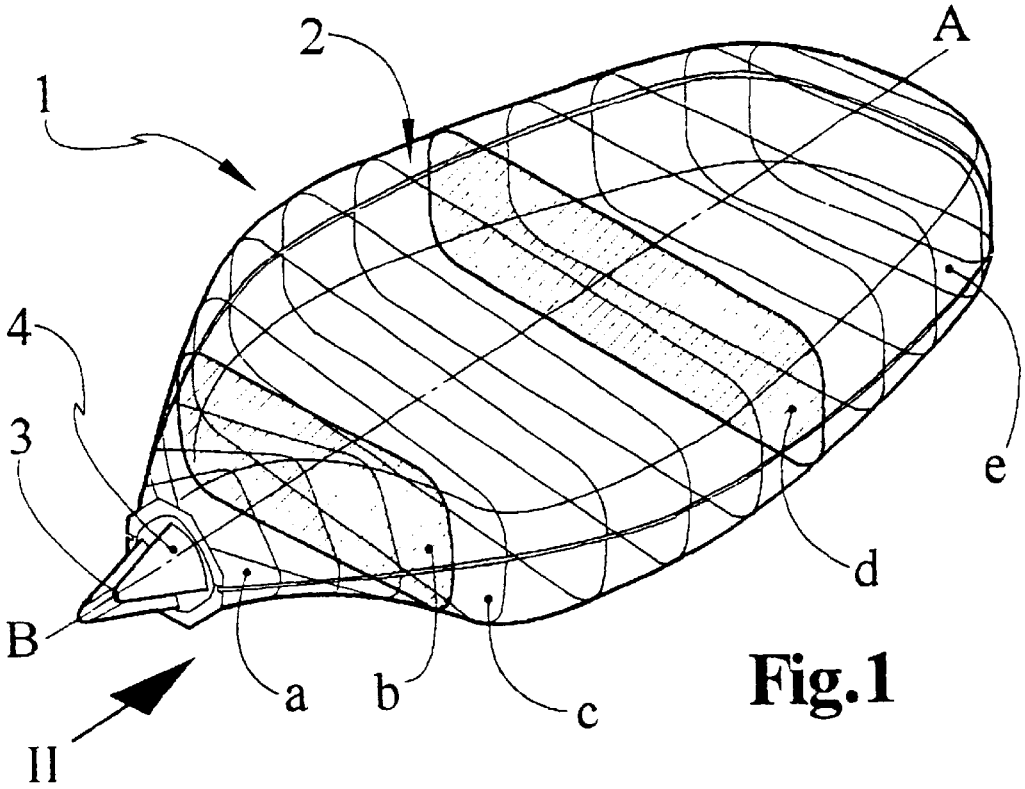

DEVICE FOR TRANSFERRING A MATERIAL IN THE FORM OF A FILM APPLIED ON A CARRIER STRIP

BACKGROUND OF THE INVENTION

It is known to guide, for example a correcting medium applied to a carrier strip, by way of a handy-to-use appliance over, for example, a line of text or regions of that line. The correcting medium then adheres to the surface of the paper and the covering material matched to the colour of the paper can then be written over once more.

Applicator means to be guided by hand on a substrate are known, for example, glue tongues with corresponding applicator spouts, so-termed marker pens which mark text positions by particularly prominent colours, and so-termed transfer dispensers which are to the forefront here, all in a mode of handling similar to writing instruments.

Devices of that kind for application of correcting ink to a sheet, wherein the correcting ink is applied as a film to a carrier strip, are indicated by EP 0 511 522 B1 or the corresponding DE 92 119 119 U1, EP 0 566 406 B1, EP 0 656 308 A1, EP 0 717 001 or FR 2 263 131 A1, wherein the working edges of the handy-to-use appliance, around which the strip with the film to be applied is guided, are arranged parallel to the axis of the storage drum or at 90° thereto. Thus, for example, EP 0 644 145 shows a working head of the device on the one hand in a strip use position, in which the working edge is arranged in the same horizontal plane as the main plane of the device housing, and on the other hand in an exchange position, in which the working edge is arranged parallel to the axes of the reels so that the strip can be easily taken away. For this purpose the head has a form of bayonet lock for positioning the working edge in the two positions.

If handy-to-use appliances with a working edge arranged parallel to the axes of the coil reels are exceedingly unsatisfactory with regard to their manipulation, the handy-to-use appliances also have the disadvantage of the working edge thereof lying in a position, or being able to be brought into a position, oriented at 90° to the reel axes. This sideways arrangement has the disadvantage that the transfer pressure to be transmitted to the strip at the working edge has to be arranged outside the centre axis of the housing, so that during manipulation a turning moment is automatically produced which has to be compensated for by the user consciously or unconsciously applying resistance, whereby the ease of manipulation is significantly impaired. Thus, it is more difficult to exert a pressure distributed uniformly over the entire application strip, i.e. the working edge.

DE 44 04 103 A1 shows a device with a working edge displaced 90° relative to the housing, the edge being spaced so far from the centre axis of the handy-to-use appliance that it does indeed remain stable when initiating correcting movements, but is unstable during the correcting movement itself, i.e. covering the text to be cancelled, as a turning moment is produced, the force of which has to be absorbed by the hand in addition to the pulling resistance.

A further disadvantage is that the carrier strip has to be deflected to an extreme degree and is, in part, twisted.

SUMMARY OF THE INVENTION

The object of the invention, apart from avoidance of the above-described disadvantages, is to provide a device which can be handled particularly comfortably and avoids excessive loading of the carrier strip.

In the case of a device of the kind denoted in the introduction this object is met in accordance with the invention in that the effective working edge of the applicator base is arranged to be inclined at an angle of 40 to 50° relative to the reel axes.

Due to the positioning of the working edge at an angle between 40° and 50° it is achieved on the one hand that no unnecessary turning moments act on the handy-to-use appliance during use thereof and on the other hand due to the comparatively small deflection of the carrier strip there is no worry about special loading of the carrier strip.

Further refinements of the invention are evident from the subclaims, in which connection it can in particular be provided that in the interior of the housing the strip guide rollers lie in substantially the same plane as the reel axes on the one hand and the centre point of the working edge on the other hand.

It is achieved by this arrangement of the deflecting rollers that the strip guidance of the carrier strip extends in a linear direction to the applicator base, which leads to a convenience of manipulation comparable with that known in, for example, ink-applying marker pens.

If the housing is designed, as known per se, in flacon-like manner with a housing region running in a point to the working edge and a slightly curved opposite edge region, wherein the notional circumferential lines perpendicular to the main axis of the housing extend helically at an offset relative to one another by a small degree of angle, a very convenient handling character of the device according to the invention results in all cases, the fingers of the user being brought by the housing shape almost automatically into the correct handling position.

The invention also proposes that the housing, as known per se, is provided in the region of the supply reel with an open filling-state inspection aperture, the supply reel is made of transparent material and the carrier disc of the strip coil of the supply reel is associated with the filling-state inspection aperture so as to cover that aperture.

Since the carrier disc, which is utilised at the same time as a cover for an inspection aperture, is associated with this aperture, a more uniform material distribution of components compared with the usual mode of construction results in the interior of the device, as the carrier disc or edge disc of the supply reel is arranged on the opposite side of the slip clutch.

THE DRAWINGS

Figure 2:
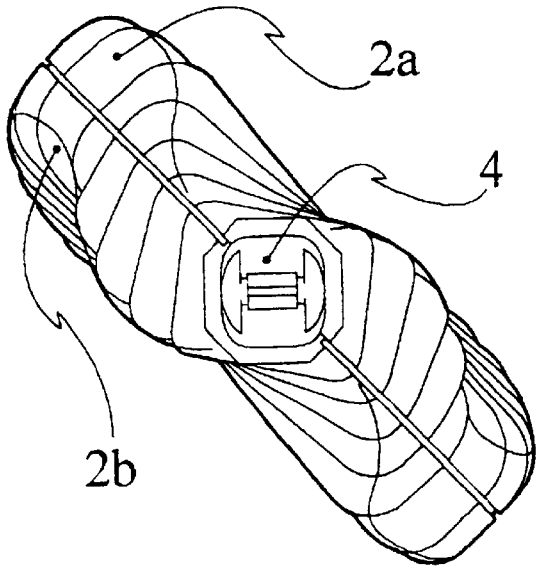
Figure 1A:
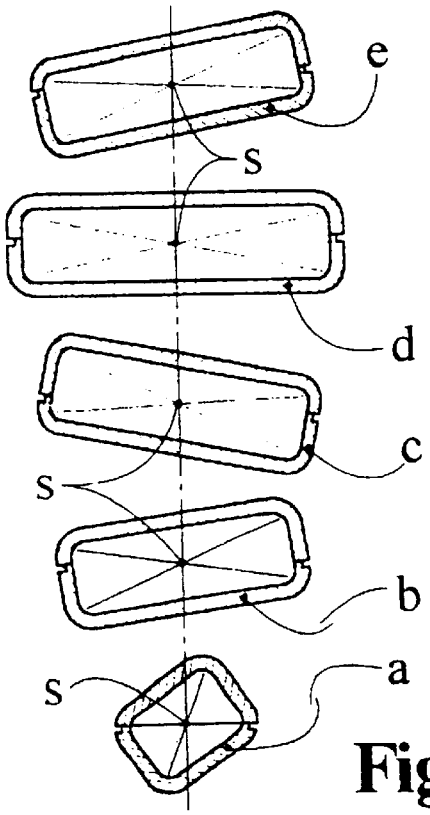
Figure 3:
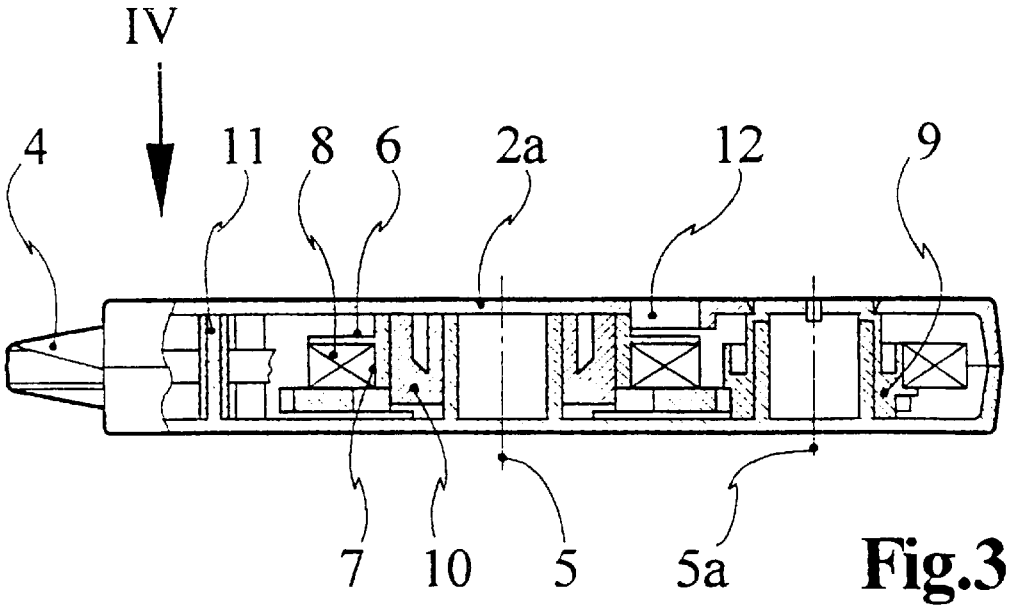
Figure 4:
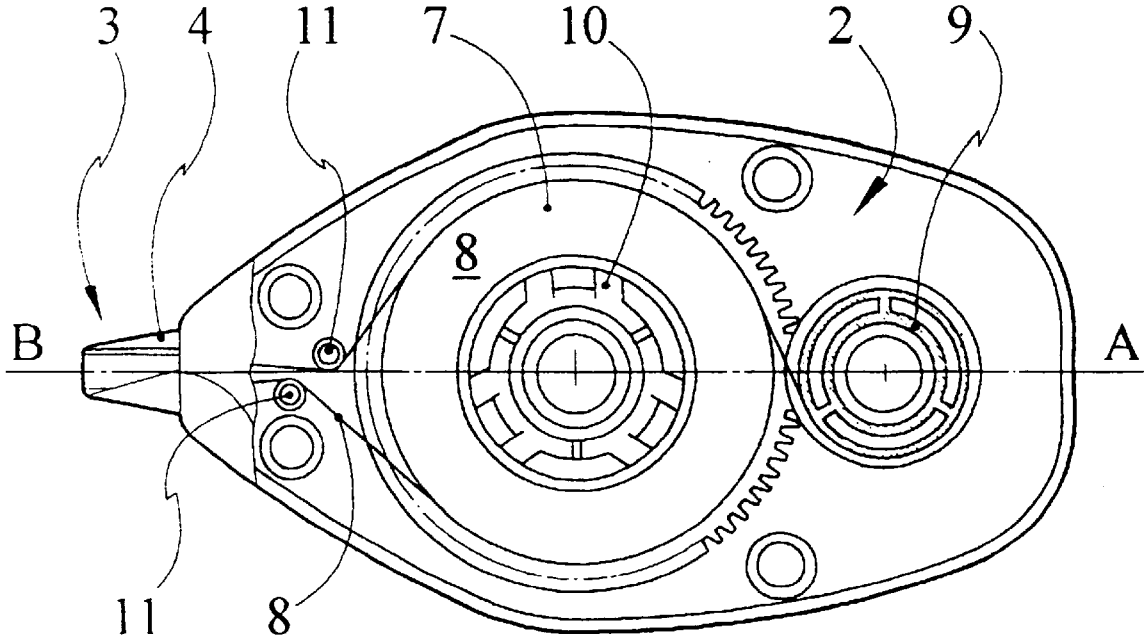
Figure 5:
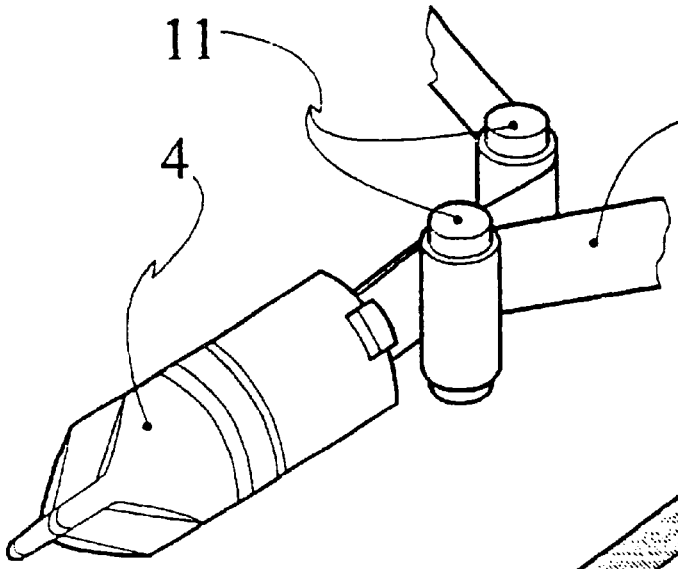
Figure 5A:
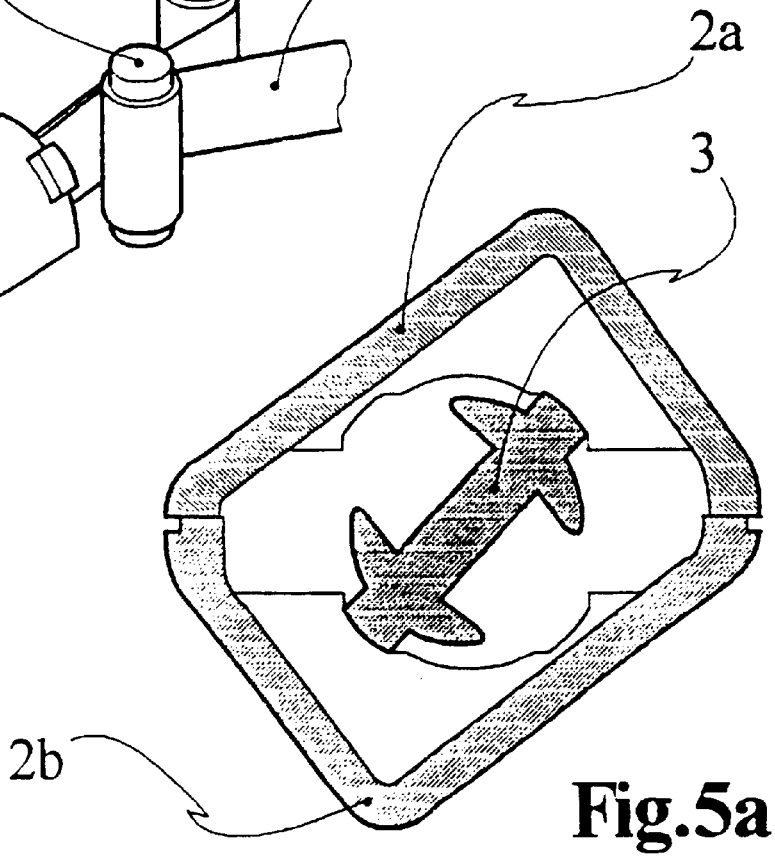
Figure 6:
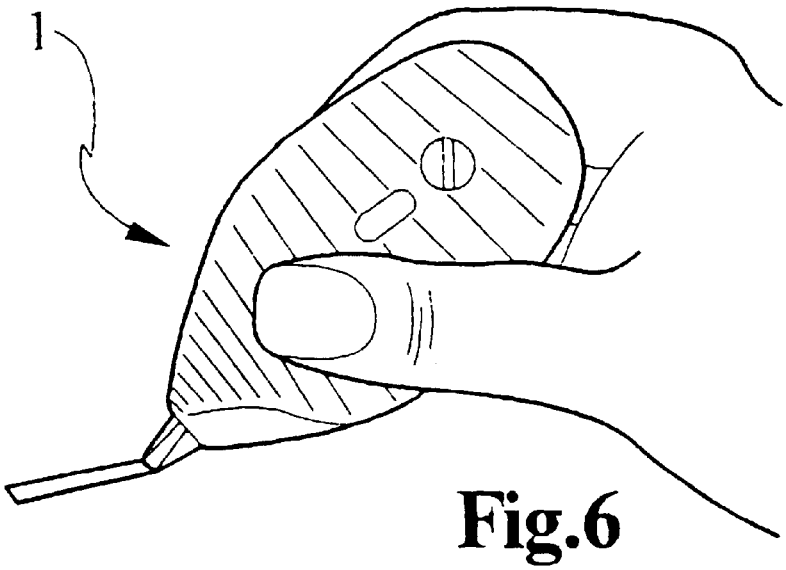

Further features, details and advantages of the invention are evident by reference to the following description and on the basis of the drawings, in which:

FIG. 1 shows a device housing, which is illustrated as a wire model, in perspective illustration, FIG. 1*a* shows individual detail sections a to e on viewing line A–B in FIG. 1, FIG. 2 shows an elevation of the housing according to the invention in accordance with arrow II in FIG. 1, FIG. 3 shows a cross-section approximately according to the line A–B in FIG. 1, with the profile of the housing edge smoothed out for reasons of illustration, FIG. 4 shows an elevation according to arrow IV in FIG. 3 with partly broken-away edge regions, FIG. 5 shows in perspective illustration the applicator base with working edge and deflecting rollers in enlarged representation, FIG. 5*a* shows the fixing of the applicator base in the housing shells, and FIG. 6 shows the matching to the hand position by virtue of the housing design.

DETAILED DESCRIPTION

The device denoted generally by 1 comprises a flacon-like housing 2, the specific shape of which is evident from the wire model illustration according to FIGS. 1 and 2. Individual cross sections, designated a to e, of the housing are illustrated in FIG. 1*a* extracted so as to be one below the other, wherein the line going through the centres of area is depicted in dot-dash form. The helically twisting ensures, in use of the device 1, a particular comfort in handling, as the housing shape is ergonomically matched to the hand of the user, as more or less evident from FIG. 6.

In the illustrated example the working edge, which is denoted by 3, of the applicator base 4 is offset by 45° relative to the reel axes 5 and 5*a* reproduced schematically in FIG. 3, wherein the reel axes 5 and 5*a* are disposed perpendicularly to the centre axis A–B depicted in FIG. 1.

As evident from, for example, FIGS. 3 and 4 a carrier strip 8 is wound up on a carrier disc 6, thus a supply reel denoted generally by 7, which carrier strip 8 which is drawn off this to be deflected over the applicator base 4 and the working edge 3 thereof and is wound up on an empty reel- or storage reel-9 in the interior of the housing 2, wherein synchronisation of the rotational movements is undertaken by a slip clutch which is denoted generally by 10 and which is not explained in more detail.

In order to facilitate guidance over the working edge 3 of the applicator base 4, two deflecting rollers 11 positioned substantially on or in the immediate vicinity of the line A–B are provided in the interior of the housing 2. The corresponding arrangement of the deflecting rollers 11 in relation to the applicator base 4 is illustrated in FIG. 5 in enlarged scale. The embedding of the applicator base 4 in the housing halves denoted by 2*a* and 2*b* is reproduced in enlarged scale in FIG. 5*a*.

A filling-state inspection aperture 12 is provided in one housing half, for example 2*a,* in the region of the supply coil of applicator strip 8. Due to the specially selected design, namely that the slip clutch 10 of the carrier disc 6 is disposed opposite, the opportunity is provided to make the carrier disc 6 from a transparent material so that this carrier disc 6 automatically closes off the filling-state inspection aperture 12 relative to the housing interior as evident from, for example, FIG. 3.

A simplified illustration of the handling of the device 1 is reproduced in FIG. 6.

The described embodiment of the invention can obviously be changed in many respects without departing from the basic concept. Thus, for example, one of the housing halves 2*a* and 2*b* can be made of transparent material and the angular setting of the working edge can vary around the 45° angle from about 40° to 50°. The twisting of the housing region in the direction of the applicator base 4 can be adapted to the manipulation of a left-handed person and others.

What is claimed is:

1. In a device for the transfer of a material, which is in the form of a film applied to a carrier strip or transferred to a substrate, such as a sheet of writing or drawing paper, comprising a supply reel for the film-coated carrier strip and an empty reel for receiving the de-coated carrier strip, wherein the coated carrier strip is guided over an applicator base and in the interior of the housing over deflector rollers, characterized in that the effective working edge of the applicator base is arranged to be inclined at only a single angle between 40° and 50° relative to the reel axes.

2. Device according to claim 1, characterized in that in the interior of the housing strip guide rollers are disposed in substantially the same plane as the reel axes and the center point of the working edge.

3. Device according to claim 2, characterized in that the housing is shaped to be a helically twisted shape with a housing region running in a point to the working edge and a slightly curved opposite edge region, wherein the notional circumferential lines perpendicular to the main axis of the housing extend helically at an offset relative to one another by a small degree of angle.

4. Device according to claim 3, characterized in that the housing is provided in the region of the supply reel with an open filling-state inspection window, the supply reel is made of transparent material and the carrier disc of the strip coil of the supply reel is associated with the filling-station inspection aperture so as to cover that aperture.

5. Device according to claim 1, characterized in that the housing is shaped to be a helically twisted shape with a housing region running in a point to the working edge and a slightly curved opposite edge region, wherein the notional circumferential lines perpendicular to the main axis of the housing extend helically at an offset relative to one another by a small degree of angle.

6. Device according to claim 1, characterized in that the housing is provided in the region of the supply reel with an open filling-state inspection window, the supply reel is made of transparent material and the carrier disc of the strip coil of the supply reel is associated with the filling-station inspection aperture so as to cover that aperture.

7. In a device for the transfer of a material, which is in the form of a film applied to a carrier strip or transferred to a substrate, such as a sheet of writing or drawing paper, comprising a supply reel for the film-coated carrier strip and an empty reel for receiving the de-coated carrier strip, wherein the coated carrier strip is guided over an applicator base and in the interior of the housing over deflector rollers, characterized in that the effective working edge of the applicator base is arranged to be inclined at an angle limited between 40° and 50° relative to the reel axes.

8. Device according to claim 7, characterized in that the applicator base is non-rotatably mounted to fix the angle of the working edge.

* * * * *